United States Patent [19]

Sullivan

[11] 4,376,483

[45] Mar. 15, 1983

[54] DEVICE FOR HOLDING AND DISPENSING A FLUID SUBSTANCE AND METHOD FOR MAKING SAME

[75] Inventor: William E. Sullivan, Blythewood, S.C.

[73] Assignee: Risdon Enterprises, Inc, Columbia, S.C.

[21] Appl. No.: 221,414

[22] Filed: Dec. 31, 1980

Related U.S. Application Data

[63] Continuation-in-part of Ser. No. 79,972, Sep. 28, 1979, abandoned.

[51] Int. Cl.[3] ..... B65D 73/00

[52] U.S. Cl. ..... 206/484; 206/525; 206/524.1

[58] Field of Search ..... 206/484, 525, 524.1, 206/524.2, 524.3, 524.9

[56] References Cited

U.S. PATENT DOCUMENTS

| | | | |
|---|---|---|---|
| 3,759,379 | 9/1973 | Wrede | 206/484 |
| 3,770,122 | 11/1973 | Thiele | 206/484 |
| 4,007,838 | 2/1977 | Awad | 206/484 |

OTHER PUBLICATIONS

Handbook of Package Engineering by Hanlon, McGraw Hill Book Company, 1971, pp. 3–7.

*Primary Examiner*—Joseph Man-Fu Moy

*Attorney, Agent, or Firm*—St. Onge, Steward, Johnston & Reens

[57] ABSTRACT

A device for holding and dispensing a substance such as a liquid, paste or the like, comprises a layer of substance absorbent but heat-sealable reservoir material, for holding the substance, that has two principal surfaces. A first sheet of heat-sealable cover material is disposed in close proximity to one of the principal surfaces of the layer and a second sheet of heat-sealable cover material is disposed in close proximity to the other of the principal surfaces of the layer. The cover materials are substantially impermeable to the substance, are different from the reservoir material, and have different and higher heat sealing temperatures than the reservoir material. The sheets and the layer are compressed together at a continuous boundary at a temperature above the heat sealing temperature of the reservoir material but below the heat sealing temperature of the cover material. Therefore, the reservoir material is fused at the boundary to prevent lateral absorbtion of the fluid substance therepast and the cover material is lightly joined but not fused to the reservoir material. Therefore, the sheets may be removed from the layer to dispense the product by applying a shear force to at least one of the sheets relative to the layer. A method of making this device is also disclosed.

4 Claims, 3 Drawing Figures

DEVICE FOR HOLDING AND DISPENSING A FLUID SUBSTANCE AND METHOD FOR MAKING SAME

This application continues in part U.S. patent application Ser. No. 6/079,972 filed Sept. 28, 1979, now abandoned.

BACKGROUND OF THE INVENTION

1. Field of the Invention

The present invention relates to a device for holding and dispensing a product such as a liquid, paste, or the like. Specifically, the present invention relates to a device for holding a product such as wax, shoe polish, perfume or a similar product.

Currently various products such as wax or shoe polish are packaged in containers such as bottles or jars and are dispensed with a separate applicator for transporting the product from the container to the area where it is to be used. However, it is desirable to package such products in amounts sufficient for but a single use in a container that may be easily disposed of after use.

2. Description of the Prior Art

Various devices for dispensing fluid products are known. For example, U.S. Pat. No. 4,094,119 (Sullivan et al.) discloses a multilayer disc-like device in which the layers are fused together at a continuous boundary. U.S. Pat. No. 3,913,789 (Miller) discloses a fluid container of the flexible wall capsule type in which portions of confronting layers are strongly sealed at a marginal area by being embossed and another portion is weakly sealed, not being embossed.

It is also known that different plastic film materials have different heat sealing temperatures, see, for example, J. F. Hanlon, *Handbook of Package Engineering*, McGraw-Hill (1977).

However, heretofore no instance is known in which the heat sealing properties of certain plastics are taken advantage of to produce a multilayer device with economic mass production techniques, the device having an easily removable cover or sealing layer and a reservoir layer in which a product such as a liquid or paste is reliably confined.

SUMMARY OF THE INVENTION

It is an object of the present invention to provide a device that can be easily utilized to hold and dispense a product such as a liquid or a paste in a convenient manner.

It is a further object of the present invention to provide such a device that holds an amount of such a product sufficient for a single use whereby the device may be discarded after use.

It is a further object of the present invention to provide an economical and efficient method for making a device of the type described above, permitting the product to be packaged in quantities suitable for but a single use.

In general accordance with the present invention, the device includes a layer of substance absorbent, heat sealable reservoir material capable of holding the substance or product to be dispensed. The layer has two principal surfaces. A first sheet of cover material is disposed in close proximity to one of the principal surfaces of the layer and a second sheet of heat sealable cover material is disposed in close proximity to the other principal surface of the layer. The cover materials are substantially impermeable to the product, are different from the reservoir material, and have heat sealing temperatures higher than the heat sealing temperature of the reservoir material. The sheets and the layer are compressed together at a continuous boundary using, for example, heat or sonic welding equipment at a temperature higher than the heat sealing temperature of the reservoir material but lower than the heat sealing temperature of the cover material. Therefore, the reservoir material is fused at the boundary to prevent lateral absorption of the substance past the boundary and the cover material sheets are lightly joined or bonded to the reservoir material layer at the boundary. Accordingly, one or both sheets may be removed or delaminated from the layer by applying a shear force to one of the sheets relative to the layer.

The method of the present invention for making the device described above comprises the step of providing a layer of heat sealable substance absorbent reservoir material capable of holding the substance and having two principal faces. The layer is filled at a location with the substance and a first sheet of heat sealable cover material substantially impermeable to the substance is placed in close proximity to one of the principal surfaces of the layer. A second sheet of heat sealable cover material is placed in close proximity to the other of the principal surfaces of the layer. The first and second sheets and the layer are compressed together at a continuous boundary at a temperature higher than the heat sealing temperature of the reservoir material but lower than the heat sealing temperature of cover material thereby fusing the reservoir material together and lightly joining the cover material sheets thereto at the boundary. Flow of the substance outwardly through the reservoir material layer at the boundary and through the cover material sheets is thus prevented.

Other objects, aspects and features of the present invention will be pointed out in or will be understood from the following detailed description provided below in conjunction with the accompanying drawings.

BRIEF DESCRIPTION OF THE DRAWINGS

FIG. 1 is a perspective view of the device of the invention for holding and dispensing a fluid substance such as a liquid, paste, or the like.

DETAILED DESCRIPTION OF THE PREFERRED EMBODIMENT

Figure 1:
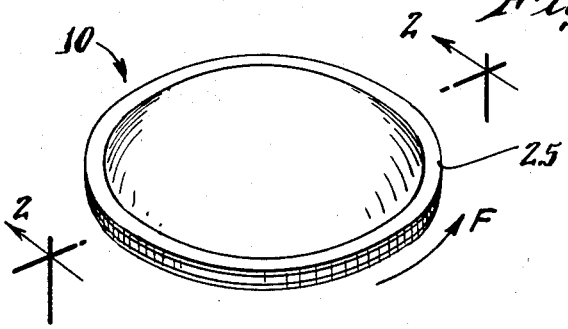

As shown in FIG. 1, the preferred embodiment of the device of the present invention, generally indicated at 10, is generally circular comprising a disc-shaped packet. The device is capable of holding a product such as a liquid, paste or the like. As shown in greater detail in FIG. 2, the device comprises a layer 12 of reservoir material that is capable of holding the product. The layer 12 has two principal surfaces 14 and 16.

The reservoir layer is preferably made of a polymeric material. It has been found that non-woven extruded (unoriented) polypropylene is particularly well suited in this application. As reported in *Guide to Plastics, Prop-*

*erty and Specification Charts,* McGraw-Hill, Inc. (1976) at page 34, the heat sealing temperature of such polypropylene lies in the range of 285° F. to 400° F.

First and second cover layers, 18 and 20 respectively, are disposed in close proximity to the first and second principal surfaces 14 and 16 of the reservoir layer respectively. These sheets are substantially impermeable to the product held by the reservoir layer. It has been found that a polymeric material is best suited for this purpose and in the preferred embodiment, the polymeric material is an extruded, biaxially oriented polyester (polyethylene terephthalate) film. As reported in *Guide to Plastics, Property and Specification Charts,* McGraw-Hill, Inc. (1976) at page 33, the heat sealing temperature of such polyester lies in the range of 425° F. to 450° F.

It is important that at least one of sheets 18 and 20 be made of a cover material that is different from and has a higher heat sealing temperature than that of the reservoir material from which the layer 12 is made. It is not necessary that the sealing materials of the respective first and second sheets be different from one another.

Figure 2:
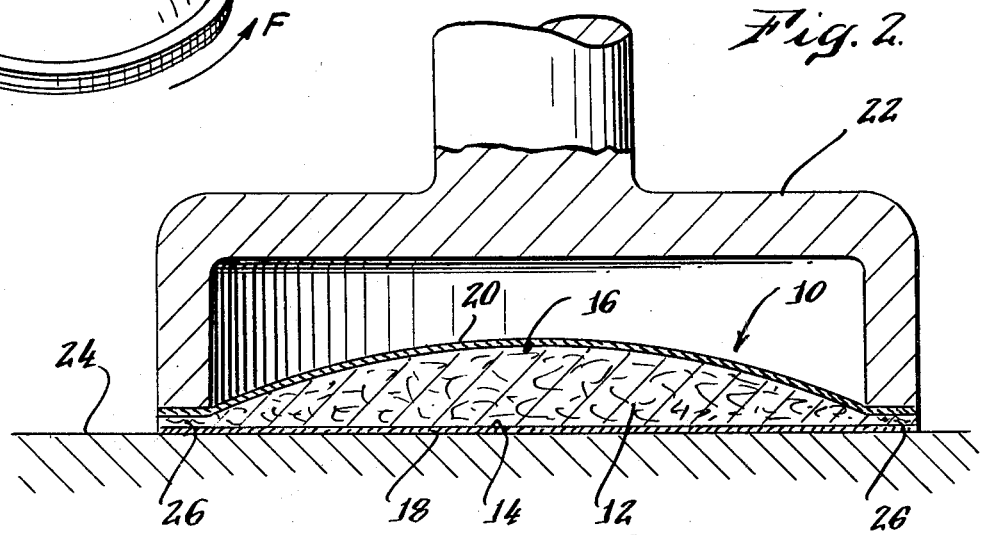
FIG. 2 is a vertical cross-sectional view taken through plane 2—2 in FIG. 1 of the device of the invention, also showing a welding horn in position to compress the respective sheets and layer together at a certain temperature.

As can be seen in FIG. 2, the first and second cover material sheets and the reservoir layer are compressed together by a welding horn 22 which coacts with a pressure plate 24 to compress the three layers of the device 10 at a continuous boundary 25. The horn 22 is adapted to compress these materials either with heat or with sonic energy or with any other technique capable of performing the compressing and heat sealing function at a temperature higher than the heat sealing temperature of the reservoir material but lower than that of the cover material. In the preferred embodiment with the materials described above, application of heat sealing temperature in the range from 410° F. to 415° F. would be satisfactory. Since the materials of the adjacent layers of the device of the invention are different and have different heat sealing temperatures as described above the reservoir material is compressed and fused at the boundary since its heat sealing temperature is exceeded to prevent lateral flow or absorbtion of the substance past the boundary. Further, the cover material sheets are lightly joined but not firmly heat sealed to the reservoir material since their heat sealing temperature is not reached.

Because heat sealing of the cover sheets and the reservoir material layer does not occur but only a light bonding is achieved, the device may be opened to release the product by applying a shear force, such as force F shown in FIG. 1, against at least one of the sheets 18 and 20 relative to the layer 12. Such shear force causes the layers to delaminate exposing the reservoir layer for release or application of the product contained therein. The shear force may be applied by placing the device between the palms of the user's hands and twisting the palms to effect the delamination described above.

Moreover, it is possible to make the device with a reservoir material layer and one cover material sheet of the same general polymeric material with the second cover material sheet of a different polymeric material provided that the cover material sheet of like material is substantially impermeable to the substance. In this case, the reservoir and cover sheet of like materials will be compressed and heat sealed together during the compressing and heat sealing step in the manufacture of the device, but the other sealing layer will not be so heat sealed. Accordingly, the second cover material sheet may be delaminated from the remainder of the device, leaving the first cover material sheet attached to the reservoir layer. In this way, a convenient surface by which the device may be grasped is provided to insulate the user's hand from the product.

Figure 3:
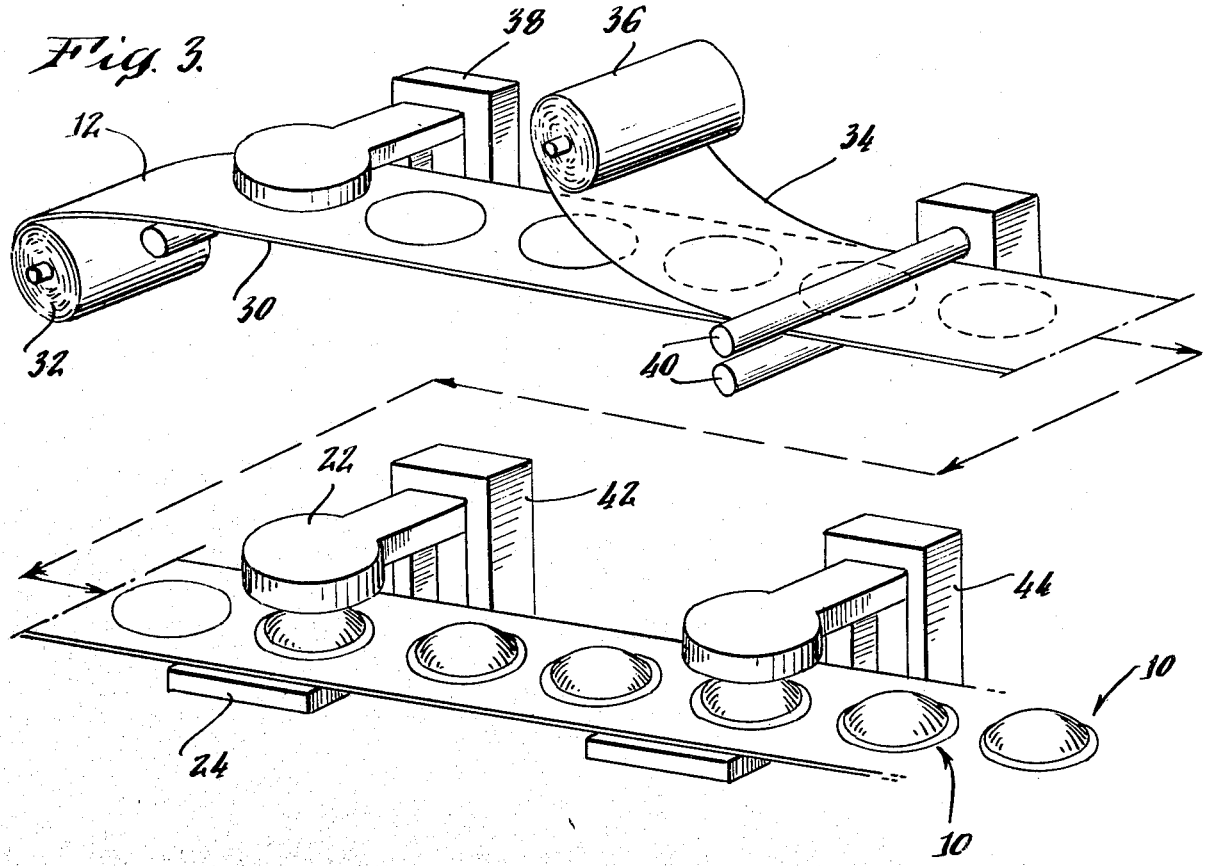
FIG. 3 is a diagrammatic perspective view of apparatus for making the device of the invention in accordance with the method of the invention.

The device of the present invention described above may be made from continuous supplies of the respective materials in the general manner described in U.S. Pat. No. 4,094,119 (Sullivan et al.) as modified as described below with reference to FIG. 3. FIG. 3 diagrammatically illustrates apparatus for producing the product described above. In accordance with the method, an endless sheet 30 of one cover material 18 is fed or continuously advanced from a supply roll 32. Simultaneously, an endless sheet 34 of the second cover material 20 is fed or continuously advanced from a second supply roll 36. The relatively thick reservoir material layer is preferably loosely adhered to the cover material sheet 30 prior to being wound on the roll 32. In this way, the cover material layer and the reservoir material are simultaneously advanced from the roll. Alternatively, the reservoir material layer may be fed from a separate supply roll to a position between the cover material sheets.

The cover material sheets and reservoir material layer are fed to a product dispensing station 38 where the product is sequentially dispensed at discreet locations to be absorbed at such locations by the reservoir material layer. Thereafter, all three materials are fed into the nip of opposing feed rollers 40 and subsequently to a fusing station 42 where the three materials are compressed and fused by a welding horn 22 and pressure plate in a manner described above in detail with reference to FIG. 2. The welding horn compresses and heats the three materials to the continuous boundary at a temperature greater than the heat swelling temperature of the reservoir material but less than the heat sealing temperature of the cover material. Therefore, the reservoir layer is fused about the continuous boundary to prevent lateral absorption of the substance past the boundary. The sealing layers are lightly joined but not firmly heat sealed to the reservoir material at the boundary. Finally, the finished products are serially fed to a punching station 44 where they are cut by a suitable mechanism from the endless sheets for individual use.

Accordingly, it will be appreciated from the description of the method provided in conjunction with FIG. 3 that the device of the invention can be conveniently and quickly made on a mass production basis.

It will also be appreciated that the device of the present invention is a simple, economical structure for holding and dispensing a product that may be easily made in accordance with the method of the present invention. The product may accordingly be conveniently dispensed and applied to a selected location without soiling the user's hands, if desired.

Accordingly, although specific embodiments of the present invention have been described above in detail, it is to be understood that this is for the purposes of illustration. Modification may be made to the described structure and method in order to adapt them to particular applications for holding and dispensing a product such as liquid, paste, or the like and for making a device for doing so.

What is claimed is:

1. A device for holding and dispensing a substance such as a liquid, paste or the like, comprising:

a layer of a compressible, heat-sealable reservoir material, capable of holding said substance, having two principal surfaces and having a heat sealing temperature;

a first sheet of heat-sealable cover material disposed in close proximity to one of said principal surfaces of said layer;

a second sheet of heat-sealable cover material disposed in close proximity to the other of said principal surfaces of said layer, said cover materials being substantially impermeable to said substance, said cover material of which at least one of said sheets is made being different from and having a heat-sealing temperature that is greater than the heat-sealing temperature of said reservoir material, said sheets and said layer being compressed together at a continuous boundary at a temperature greater than the heat-sealing temperature of said reservoir material but less than the heat-sealing temperature of said cover material of which said one sheet is made, whereby said reservoir material is compressed and fused at said boundary to prevent lateral absorption of said substance therepast and said one sheet is lightly joined but not heat-sealed to said layer at said boundary, whereby said one sheet may be removed from said layer by applying a shear force thereto relative to said layer.

2. A device as claimed in claim 1, wherein said cover material of which said one sheet is made is polyester film having a heat-sealing temperature in the range from about 425° F. to about 450° F.

3. A device as claimed in claim 1, wherein said reservoir material is polypropylene having a heat-sealing temperature in the range from about 285° F. to about 400° F.

4. A device as claimed in claim 1, wherein said cover material of which said one sheet is made is polyester film having a heat-sealing temperature in the range from about 425° F. to about 450° F. and said reservoir material is polypropylene having a heat-sealing temperature in the range from about 285° F. to about 400° F.

* * * * *